United States Patent [19]

Brooks et al.

[11] 4,147,470

[45] Apr. 3, 1979

[54] INSULATED FAN FOR ELECTRIC APPLIANCE

[75] Inventors: Joseph F. Brooks; Robert W. Elderton, both of Bloomington, Ill.

[73] Assignee: National Union Electric Corporation, Greenwich, Conn.

[21] Appl. No.: 763,803

[22] Filed: Jan. 31, 1977

[51] Int. Cl.[2] ..... F04D 29/28

[52] U.S. Cl. ..... 416/95; 416/188; 416/241 A

[58] Field of Search ..... 416/241 A, 93 R, 95, 416/188; 415/177, 215

[56] References Cited

U.S. PATENT DOCUMENTS

| | | | |
|---|---|---|---|
| 2,428,728 | 10/1947 | Watson | 416/95 X |
| 2,438,866 | 3/1948 | Rockwell et al. | 416/244 A X |
| 2,836,348 | 5/1958 | McDonald | 416/95 |
| 3,387,768 | 6/1968 | Zoehfeld | 416/241 A X |
| 3,521,973 | 7/1970 | Schouw | 416/241 A X |
| 3,622,249 | 11/1971 | Hayashi et al. | 416/241 A X |
| 3,659,471 | 5/1972 | Marsch | 416/241 A X |
| 3,749,519 | 7/1973 | Ryba | 416/241 A |
| 3,846,045 | 11/1974 | Mincuzzi | 416/241 A X |
| 3,932,062 | 1/1976 | Sisk | 416/241 A X |

FOREIGN PATENT DOCUMENTS

| | | | |
|---|---|---|---|
| 427135 | 3/1926 | Fed. Rep. of Germany | 416/95 |
| 1017320 | 10/1957 | Fed. Rep. of Germany | 416/185 |

*Primary Examiner*—Everette A. Powell, Jr.
*Attorney, Agent, or Firm*—Alfred E. Miller

[57] ABSTRACT

A fan and motor assembly for an electric appliance, wherein the fan is comprised of a plastic material and has a mounting hole of a diameter greater than the shaft diameter of the motor. Insulating washers closely fitted in annular recesses at the end of the mounting hole have inner diameters substantially the same as that of the shaft for centering the fan on the shaft.

5 Claims, 4 Drawing Figures

INSULATED FAN FOR ELECTRIC APPLIANCE

BACKGROUND OF THE INVENTION

This invention relates to motor and fan assemblies especially adapted for use in electric appliances, and is particularly directed to fans and fan assemblies wherein the fan is formed of a plastic material.

The assemblage of a fan on the shaft of an electric motor for use in an electric appliance is, of course, quite well known. The present invention is particularly directed to the use of such fans and fan assemblies for electric vacuum cleaners, although it will be apparent that the invention may also be advantageously employed in other appliances.

When a fan is employed in a vacuum cleaner, it is conventionally mounted to the shaft of the motor. This mounting may be effected, for example, by means of a threaded pulley on the end of the shaft, the face of the pulley exerting mounting pressure on the face of the hub of the fan. Conventional belts couple the pulley to the working components of the vacuum cleaner.

Under normal operating conditions, heat generated, for example, in the motor, is readily dissipated so that no damage may result to the fan. On occasion, however, the heat generated may become extensive. This may occur, for example, if the motor is stilled, or if the belt engaging the pulley slips excessively. If the fan is of a conventional metallic material, for example, a die-cast fan, the generation of such additional heat will generally result in no damage to the fan.

For a number of reasons it may be desirable to employ a plastic fan in vacuum cleaners. For example, plastic fans may be readily molded as unitary members, thereby reducing their cost. In addition, some of the newer plastic materials, such as polycarbonate, are particularly adaptable to this use since, when properly molded, such materials are substantially "unbreakable."

It has been found, however, that plastic fans are more subject to damage as a result of heat. Thus, the plastic materials are in general thermal insulators, in the sense that their coefficient K of heat transfer is substantially less than that of previously employed metallic materials. This can result in the buildup of the temperature at the hubs of the fans, particularly under adverse conditions. The additional heat may result in the "cold flow" of the plastic material since the hub of the fan is subjected to mechanical mounting forces. As a consequence, the material of the hub of the fan may flow over the mounting nut or pulley so that effective mounting of the fan on the shaft no longer exists. The fan may thereby become subject to slippage and damage to result in a further buildup of heat in the assembly with consequent damage to the fan and also the possibility of damage to the motor itself.

The present invention is directed to the provision of means for overcoming the above problem when the fan of an electric appliance is formed of a plastic material. Specifically, in accordance with the invention, the mounting hole in the hub of the fan has a larger diameter than that of the shaft and insulating washers are mounted in annular recesses at each end of the mounting hole. The washers have internal diameters substantially the same as that of the shaft so that the fan may be centered and rigidly mounted to the shaft. The washers, although of a heat insulating material, may be expediently of a material that is not subject to cold flow. The provision of the washers and the spacing between the fan and the shaft of the motor prevents the passage of sufficient heat to the fan to effect the cold flow of the fan. As a consequence, damage to the fan, and resultant damage to the remainder of the assembly, may be avoided under adverse conditions even though the fan is of a plastic material.

In order that the invention will be more clearly understood, it will now be disclosed in greater detail with reference to the accompanying drawings, wherein.

DESCRIPTION OF THE PREFERRED EMBODIMENT

Figure 1:
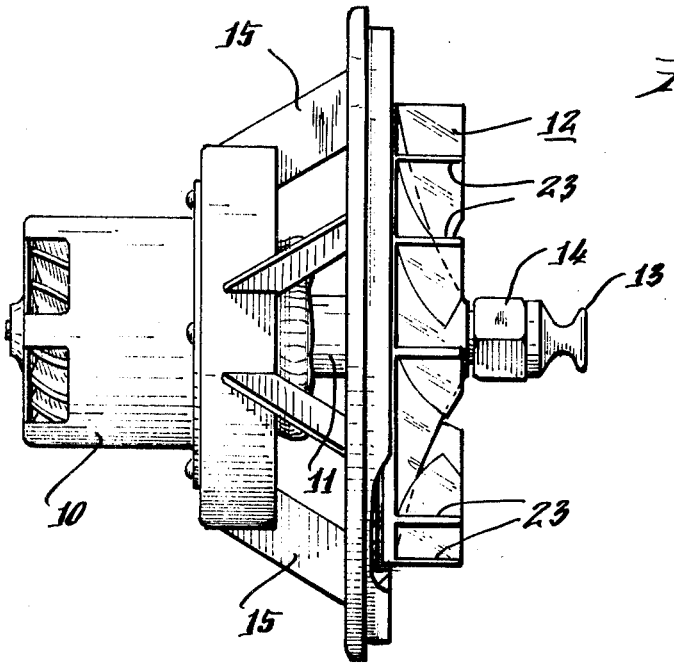
FIG. 1 is a side view of a fan and motor assembly, which may employ the present invention.

FIG. 1 illustrates generally a fan and motor assembly of a type that may be employed in an electric vacuum cleaner. The assembly includes a motor 10 of conventional nature and having a shaft 11. A fan 12 is mounted for rotation with the shaft, and a pulley 13 forms a part of a nut 14 threaded on the end of the shaft 11 for holding the fan on the shaft. A suitable conventional belt (not shown) may be provided for driving the parts of the vacuum cleaner by means of the pulley 13. In addition, suitable conventional air flow directing superstructure 15 may be mounted to the motor 10 and extend adjacent to the fan 12, in order to insure the flow of air in the proper direction when the assembly is mounted on the vacuum cleaner. The shape of the superstructure 15 is, of course, dependent upon the configuration and style of the vacuum cleaner, and does not form a part of the invention per se.

Figure 2:
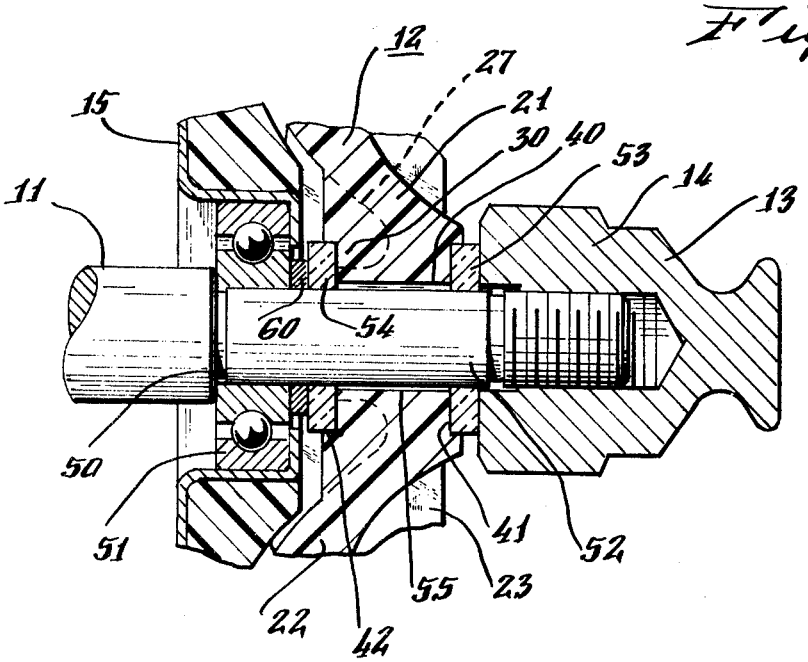
FIG. 2 is an enlarged cross-sectional view of a portion of the fan and motor assembly of FIG. 1, taken along the axis of the motor and fan.
Figure 3:
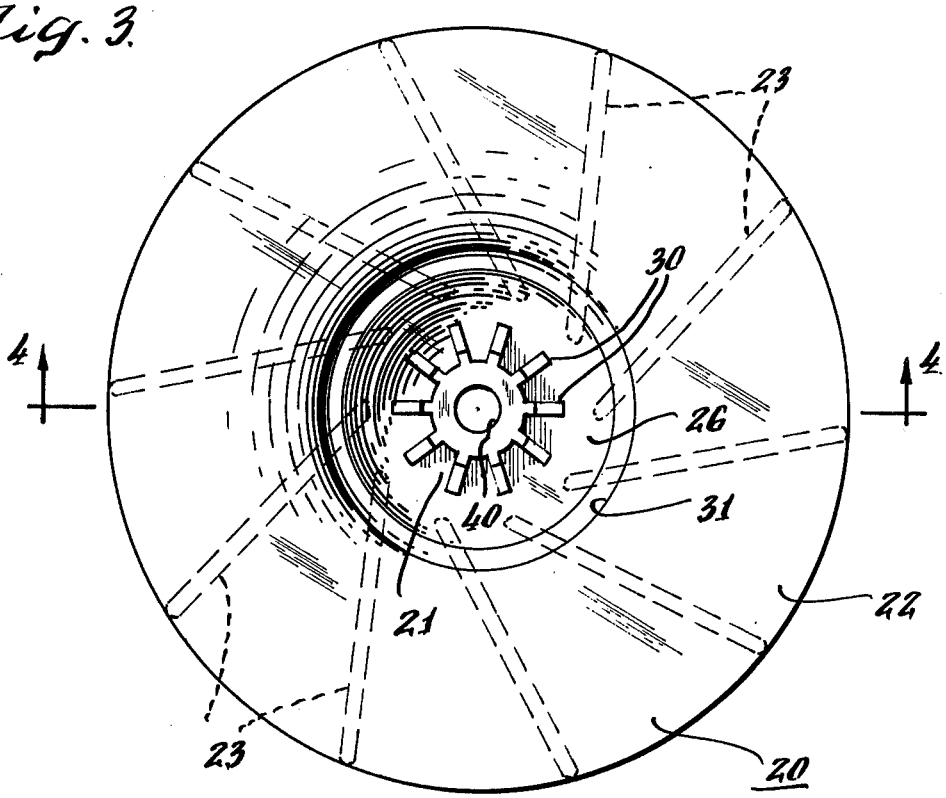
FIG. 3 is a bottom view of the fan of the assembly of FIG. 1.
Figure 4:
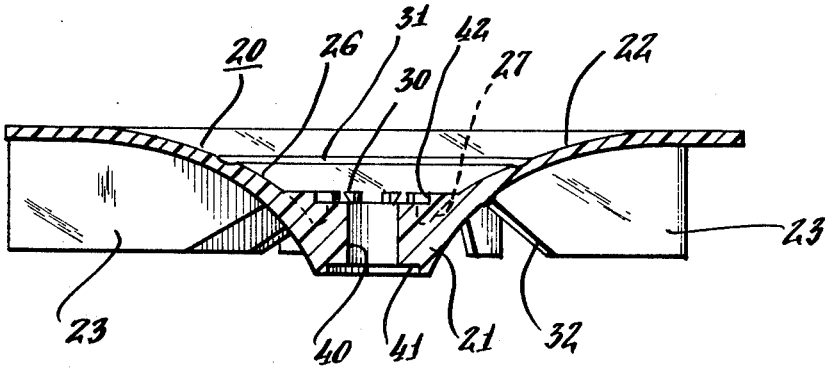
FIG. 4 is a cross-sectional view of the fan of FIG. 3, taken along the lines IV—IV.

As illustrated in FIGS. 2, 3 and 4, the fan 12 is comprised of a base portion 20 generally including a central hub 21 and a disc 22 extending radially from the hub. A plurality of fins 23 extend generally radially, in planes parallel to the axis of the hub, from the top of the disc 22.

The outer extremities of the disc 22 may be generally flat in a plane normal to the axis of the fan, as is apparent in FIG. 4. Centrally, however, the disc curves upwardly from this plane, slightly thickened, to join the bottom of the hub 21. The generally curved undersurface 26 of the disc continues onwardly into the hub, as is apparent in FIGS. 2 and 4, so that in effect a generally annular groove 27 is formed at the juncture of the bottom of the disc and the bottom of the hub. This groove is bridged by radially extending ribs 30. This feature enables a reduction of the weight of the fan without effectively diminishing its strength. The annular groove 31 illustrated in the bottom surface 26 of the disc in FIG. 4 may be provided, as necessary, for clearance with respect to the shape of the superstructure 15 of FIG. 1.

The fins 23 are disposed equally spaced on the upper surface of the disc and may have axially extending outer edges. The inner edges 32 of these fins preferably do not extend to join the hub 21, and hence may be angled downwardly as illustrated in FIG. 4. As is apparent in FIG. 3, the planes in which fins extend may be tangential with a common imaginary circle (not shown) coaxial with the hub 21 as shown, or they may extend radially from the hub 21.

The hub 21 has a central axially extending mounting hole 40, and an annular recess 41 is provided in the top of the hub, i.e., at the upper end of the hole 40. In addition, an annular recess 42 is provided at the bottom end of the hole 40 in the hub 21. The outer periphery of the recess 41 may be defined by continuous material of the hub itself, although as illustrated in FIGS. 2–4, the outer periphery of the recess 42 may be defined by axially extending inner edges of the ribs 30.

The fan of the invention is preferably molded as a unitary element from a plastic material, and it is particularly advantageous for the fan to be molded from a high strength plastic material, such as a polycarbonate material. An example of a suitable material for this purpose is Lexan.

In the preferred embodiment of the invention, as shown in FIG. 4, the upper surface of the disc 22 curves smoothly from its outer flattened portion upwardly to join the outer periphery of the top of the hub. In addition, the upper edges of the fins 23 lie in a common plane normal to the axis of the fan.

Referring now to FIG. 2, in a typical mounting arrangement the shaft 11 of the motor may have a shoulder 50 against which a suitable bearing 51 rests, whereby the portion 52 of the shaft extending from the motor assembly has a somewhat reduced diameter. The outer end of the shaft portion 52 is threaded. A washer 53 is assembled in the annular recess 41, and a washer 54 is assembled in the annular recess 42. The washers 53 and 54 have low heat transfer coefficients, so that they provide some degree of thermal insulation between the fan and adjacent metal parts. They are not, however, of plastic materials subject to cold flow, and for this purpose fiber washers have been found to be suitable. The washers 53 and 54 have sizes to closely fit their respective annular recesses. The inner diameters of the washers 53 and 54 are substantially equal to the diameter of the portion 52 of the shaft, and it is to be particularly noted that the hole 40 of the hub has a diameter that is larger than the diameter of the portion 52 of the shaft. As a consequence, the washers 53 and 54 center the fan hub on the shaft portion 52, with an annular space 55 between the shaft portion 52 and the inner surface of the hub 40. As a consequence, the hub of the fan is not in close thermal contact with the shaft. As an example, the diameter of the hole 40 may be 0.005 to 0.125 inches greater than the diameter of the shaft portion 52.

The nut 14, which carries the pulley 13 is threaded on the end of the shaft 52 to engage the washer 53 and thereby urge the washers, fan and the bearing toward a shoulder 50 of the shaft. If desired, a further washer 60, which may be a metal washer may be provided between the bearing 51 and the washer 54 to provide mechanical support or to properly space the fan from the motor assembly. Axial forces are present on the fan through the insulation washers due to the threading of the nut 14 on the shaft which thereby serves to firmly hold the fan on the shaft 52.

In the arrangement in accordance with the invention, it is thereby apparent that the washers 53 and 54 firmly hold the fan axially and radially while centering it at a position so that it does not touch the shaft portion 52. As a consequence, heat from the motor or pulley cannot pass directly through the shaft to the fan and the tendency of the plastic fan to cold flow is thereby substantially reduced.

While the invention has been disclosed and described with reference to a single embodiment, it is apparent that variations and modifications may be made therein. It is therefore intended in the following claims to cover each such variation and modification as falls within the true spirit and scope of the invention.

What is claimed is:

1. In a fan for a vacuum cleaner, wherein the fan has a base portion including a hub, and a plurality of fins extending from said base portion, and a coaxial mounting hole extending through said hub, the improvement wherein said base portion and fins comprise a unitary member of a plastic material, said hub having an annular recess at each end of said mounting hole and coaxial with said hole, and a separate flat thermally insulating washer mounted in each said recess with a close fit, said washers having inner diameters less than that of said mounting hole and thicknesses greater than the depths of said recesses.

2. The fan of claim 1, wherein said fan is comprised of a polycarbonate material.

3. The fan of claim 1 wherein said base portion of said fan further includes a disc extending radially outwardly from said hub, said fins extending from one side of said disc in planes parallel to the axis of said fan.

4. In a fan and motor assembly for a vacuum cleaner, wherein the fan has a base portion with a hub, and a plurality of fins extending from said base portion, said hub has a coaxial mounting hole, said motor has a shaft extending through said hole, and means including a pulley are provided for holding said hub on said shaft, the improvement wherein said base portion is comprised of a plastic material, said hub has an annular recess at each end of said mounting hole, said hole has a diameter greater than the diameter of said shaft whereby an annular space is formed therebetween and further comprising an insulating washer mounted in each of said annular recesses and having inner diameters engaging said shaft for centering said hub on said shaft said base portion and fins of said fan comprising a unitary molded plastic body, one of said washers engaging said pulley and separating said pulley from said fan.

5. The fan and motor assembly of claim 4 wherein said base portion of said fan further comprises a disc having a generally flat outer periphery and a curved inner portion extending radially inwardly to join said hub, said fins extending from a side surface of said disc in planes parallel to and substantially equally spaced from the access of said hub.

* * * * *